US009466910B2

(12) United States Patent
Lee

(10) Patent No.: US 9,466,910 B2
(45) Date of Patent: Oct. 11, 2016

(54) ELECTRIC CONNECTOR HAVING TERMINALS WITH OUTWARDLY EXTENDING EXTENSION ARMS

(71) Applicant: RIIDEA INTERNATIONAL CORP., Apia (WS)

(72) Inventor: Lung-Hsi Lee, New Taipei (TW)

(73) Assignee: RIIDEA INTERNATIONAL CORP., Apia (WS)

( * ) Notice: Subject to any disclaimer, the term of this patent is extended or adjusted under 35 U.S.C. 154(b) by 0 days.

(21) Appl. No.: 14/796,524

(22) Filed: Jul. 10, 2015

(65) Prior Publication Data

US 2016/0028178 A1 Jan. 28, 2016

(30) Foreign Application Priority Data

Jul. 28, 2014 (TW) ..... 103213362 U

(51) Int. Cl.

| | |
|---|---|
| ***H01R 13/40*** | (2006.01) |
| ***H01R 13/405*** | (2006.01) |
| ***H01R 12/70*** | (2011.01) |
| ***H01R 12/72*** | (2011.01) |
| ***H01R 24/76*** | (2011.01) |
| ***H01R 43/24*** | (2006.01) |
| *H01R 103/00* | (2006.01) |
| *H01R 43/16* | (2006.01) |

(52) U.S. Cl.

CPC ..... *H01R 13/405* (2013.01); *H01R 12/707* (2013.01); *H01R 12/7088* (2013.01); *H01R 12/724* (2013.01); *H01R 24/76* (2013.01); *H01R 43/24* (2013.01); *H01R 43/16* (2013.01); *H01R 2103/00* (2013.01)

(58) Field of Classification Search

CPC ..... H01R 12/707; H01R 12/724; H01R 12/7088; H01R 13/405; H01R 43/16; H01R 43/24

USPC ..... 439/79, 80, 736, 626, 289, 824, 744, 439/733.1

See application file for complete search history.

(56) References Cited

U.S. PATENT DOCUMENTS

| | | | | | |
|---|---|---|---|---|---|
| 4,568,136 | A * | 2/1986 | Reuss | H01R 27/02 | 439/629 |
| 4,771,538 | A * | 9/1988 | O'Loughlin | H01R 43/16 | 29/863 |
| 4,815,982 | A * | 3/1989 | Sadigh-Behzadi | H05K 3/308 | 439/382 |
| 5,108,317 | A * | 4/1992 | Beinhaur | H01R 43/24 | 264/274 |
| 6,146,182 | A * | 11/2000 | Wang | H01R 13/6275 | 439/357 |
| 6,206,735 | B1 * | 3/2001 | Zanolli | H01R 12/585 | 439/404 |

(Continued)

*Primary Examiner* — Amy Cohen Johnson
*Assistant Examiner* — Milagros Jeancharles
(74) *Attorney, Agent, or Firm* — Muncy, Geissler, Olds & Lowe, P.C.

(57) ABSTRACT

The present disclosure relates to an improved structure of an electric connector. Each of terminals has a butt joint part and is vertically linked with a joint part, and each joint part has an arch-shaped necked-down section with two grooves , and other side of joint part is linked with a positioning section which has an accommodating cavity and a protruding body separately formed at two opposite side surfaces thereof and is linked with an extension arm by other side. The extension arm is linked with an insertion section in a vertical direction. The insulative base member is formed integrally to encapsulate terminals, butt joint parts can be suspended and extended in a docking chamber, and extension arms and soldering parts are respectively exposed out of the insulative base member, so the terminals can be tightly fastened in insulative base member and the endurability of the electric connector can be enhanced.

7 Claims, 7 Drawing Sheets

(56) References Cited

U.S. PATENT DOCUMENTS 6,592,382 B2 * 7/2003 Wurster ..... H05K 3/366
439/82
7,104,811 B2 * 9/2006 Sakata ..... H01R 43/16
439/79
8,192,206 B1 * 6/2012 Ju ..... H01R 12/57
439/66
9,136,631 B2 * 9/2015 Naito ..... H01R 13/40
2014/0030932 A1 * 1/2014 Lee ..... H01R 43/24
439/693
2014/0352145 A1 * 12/2014 Lee ..... H01R 43/24
29/876

* cited by examiner

ELECTRIC CONNECTOR HAVING TERMINALS WITH OUTWARDLY EXTENDING EXTENSION ARMS

BACKGROUND OF THE INVENTION

1. Field of the Invention

The present disclosure relates to an improved structure of an electric connector, more particularly to the electric connector which has a plurality of terminals with better stability and endurability, and the plurality of terminals are fastened inside the insulative base member by joint parts, so the butt joint parts of the terminals are not easy to loosen while being inserted, and the purpose of enabling the electric connector to have nice usage effect can be achieved.

2. Description of the Related Art

With continuous progress in technology, the electric products and electronic products applied in people's life and works make people more convenient and comfortable. Most electrical products and electronic products require electric power to normally operate. Various household appliances including boombox, audio equipment, home theater equipment or multimedia player (such as VCD, DVD, Blu-ray DVD and so on), personal computer, notebook, tablet computer, smart phone or cell phone, or computers and equipment for work applications (such as printer, scanner, fax machine, copier and so on) require power source for operation. After a power connector of the electronic product is inserted with a latest power connector, a plug at other side of a transmission line linked with the latest power connector can be inserted into a sock of a commercial electric system for providing the electric power to the electronic product.

Metal terminals are necessary components of the power connectors applied in electrical electronic products. The metal terminal applied in common power connector can be classified into rivet-type and one-piece type. For forming the rivet-type of the metal terminal of the power connector, as shown in FIG. 6 and FIG. 7, a metal bar is used to form a butt joint part A by punching press manner or lathing process, a metal plate is used to form a connection part B by the punching press manner, a terminal A1 of the butt joint part A of the metal terminal is electrically connected with the connection part B through a riveting manner, a lower part of the connection part B is further bent to form a bent part B1, and an insulative plastic seat C can be formed to encapsulate the butt joint parts A and the connection parts B of the metal terminals by an insert molding process. The butt joint parts A and the connection parts B of the metal terminals are separately produced and then assembled by the riveting manner, so the manufacturing process is complex and cost is increased. In addition, contact areas between the metal terminals and the metal plate may be broken and reduced by the riveting process, so poor contact is easily occurred on the riveting parts between the terminals A1 of the butt joint parts A and the connection parts B, and problem of instable electric transmission or interruption may occur to cause degradation of the yield rate of the electric connector.

Moreover, for forming the one-piece metal terminal, a butt joint end D is formed by the punching press process, and a connection end D1 is formed at a side of the butt joint end D by the punching press process, and other side of the connection end D1 opposite to the butt joint end D is bent to form a soldering end D2, and a bent part D3 is formed and linked between the connection end D1 and the butt joint end D. The metal terminal is processed by the punching press for many times, so cold forging effect may be occurred to make the material of the metal terminal become harder, and when subsequent bent operation is performed on the metal terminal, the stress concentration may occur at the bent part D3 and cause breaking or damage of the bent part D3, it results in degradation of the yield rate of the metal terminal and poor quality of electric signal transmission. While the metal terminal is formed by the riveting process or the punching press process, it is easy to break structure of the metal terminal and degrade the yield rate and the signal transmission performance. There are many problems and detects to be solved in actual application.

Therefore, what is need is to solve the defects and the problems of the degradation in structural quality and yield rate of the traditional metal terminal due to shaping process and the poor endurability of the power connector due to shaping process of the insulative plastic seat.

SUMMARY OF THE INVENTION

In order to solve the above-mentioned problems and defects in the conventional technology, the inventor collects relevant data to design the electric connector of the present disclosure according to the long-term experience and many tests. In the electric connector, the butt joint part and the soldering part of each terminal are linked through a joint part which has a necked-down section with grooves, whereby the stress concentration can be reduced during a bent process, the possibility of breaking the bent part of the terminal can be decreased, and the yield rate of the terminal can be increased, so that the endurability of the electric connector can be enhanced.

According to an aspect of the present disclosure, each of a plurality of terminals has a butt joint part at a side thereof and linked with a joint part in a vertical direction via other side thereof, the joint part has an arch-shaped necked-down section which defines two grooves at two opposite sides thereof, and other side of the joint part is linked with a positioning section of a soldering part in the vertical direction. Each positioning section has an accommodating cavity and a protruding body respectively formed at two opposite sides thereof, and other side of the positioning section is linked with an extension arm outwardly inclined and gradually shrunk, and other side of the extension arm is linked with an insertion section in the vertical direction. The insulative base member is integrally formed by an insert molding manner to encapsulate the plurality of terminals, the butt joint parts of the plurality of terminals be suspended and extended into a docking chamber inside of the insulative base member, and the extension arms and insertion sections of the soldering parts of the plurality of terminals are respectively exposed out of the insulative base member, so that the plurality of terminals can be tightly fastened in the insulative base member and hard to fall out of the insulative base member, and the endurability of electric connector can be enhanced.

According to other aspect of the present disclosure, a suspending end of the butt joint part of each terminal of the electric connector defines an oblique cone surface outwardly and gradually shrunk, other side of each butt joint part is linked with the arch-shaped joint part, a width of each joint part is equal to a diameter of the butt joint part. Each joint part has a necked-down section located at a bent part thereof and the necked-down section defines two grooves at two opposite sides thereof. Each joint part is linked with the positioning section of the soldering part in a direction vertical to the butt joint part, and an extension arm is formed at a side of the positioning section of the soldering part of each terminal, the extension arm is outwardly inclined and gradually shrunk and the shrunk side of each extension arm is linked with an insertion section to provide the soldering part and the butt joint part to be linked by right angle. By a manner of forming the arch-shaped joint parts respectively between the butt joint parts and the soldering parts of the plurality of terminals and forming two opposite grooves at the necked-down section of each joint part, the stress concentration occurred on the necked-down section can be reduced to avoid the joint part from being broken. Therefore, the yield rate of the plurality of terminals can be improved, and the purpose of stably transmitting electric signal and improving the endurability of the electric connector can be achieved.

According to other aspect of the present disclosure, the butt joint parts of the plurality of terminals are respectively linked with the positioning sections of the soldering parts by the joint parts in a vertical direction, and other side of each positioning section is linked with the extension arm outwardly inclined and gradually shrunk, and other side of each extension arm is linked with the insertion section. The inclined angle (such as 30 degrees, 45 degrees or 60 degrees) and extension length (such as 1 mm, 1.5 mm, 2 mm or 2.5 mm) of each extension arm can be various to control the offset distance of the insertion section extended to the outer side of the butt joint part and adjust the distance between the insertion sections out of the positioning surface of the insulative base member, for cooperating with the insertion holes having different pitches on the predetermined circuit board. Therefore, it facilitates to align and insert the insertion sections of the terminals into the insertion holes of the predetermined circuit board.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
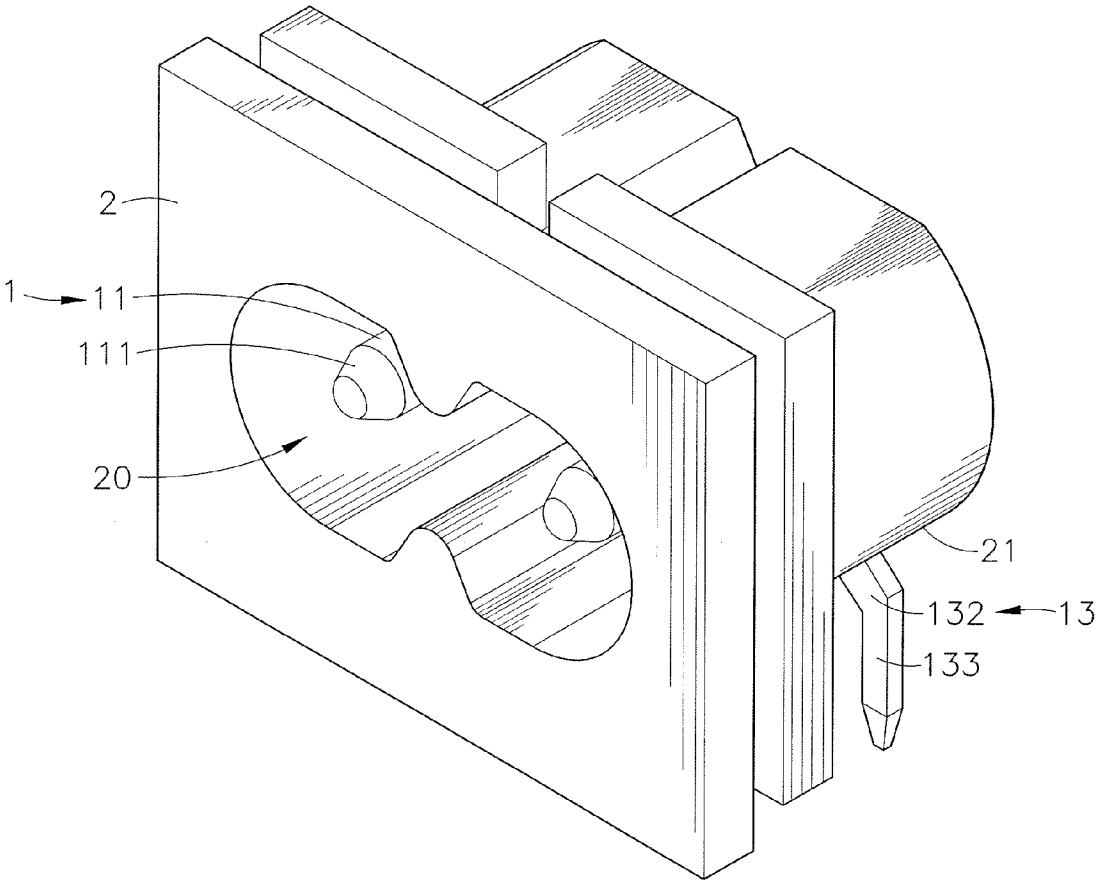
FIG. 1 is an elevational view of an electric connector of the present disclosure.
Figure 2:
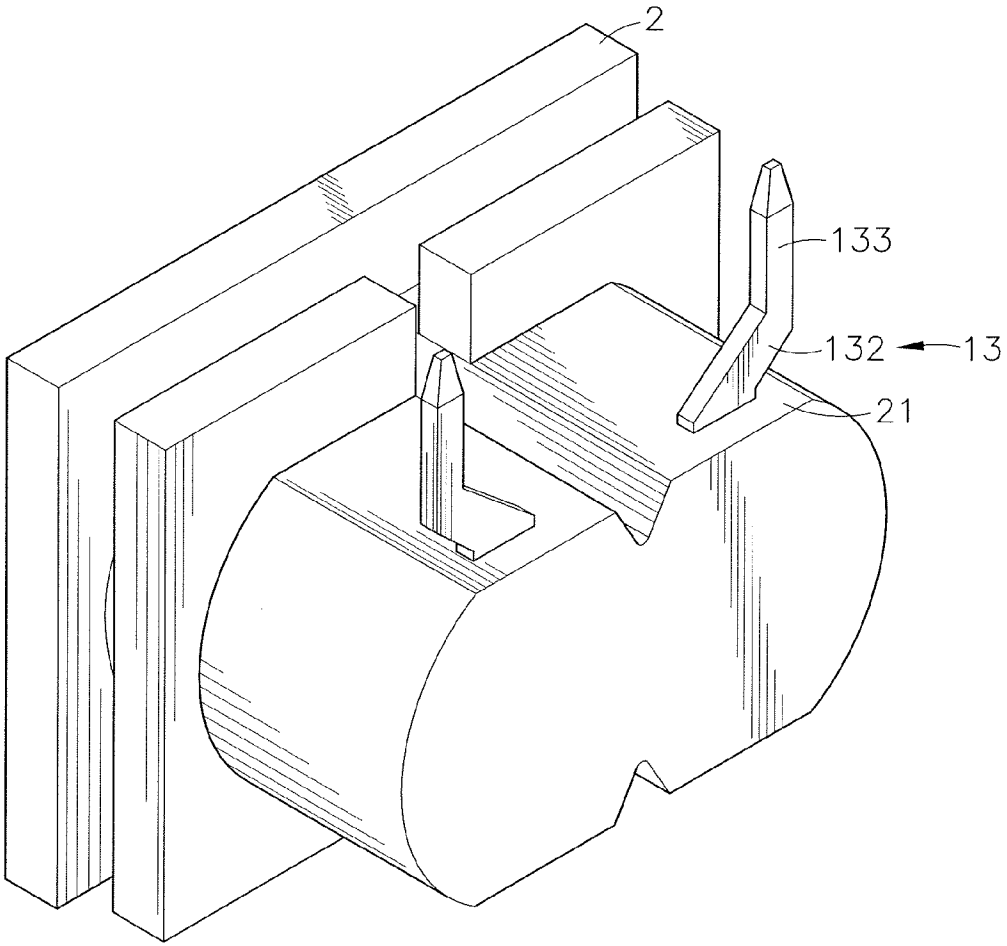
FIG. 2 is an elevational view corresponding to the FIG. 1 while viewed from another angle.
Figure 3:
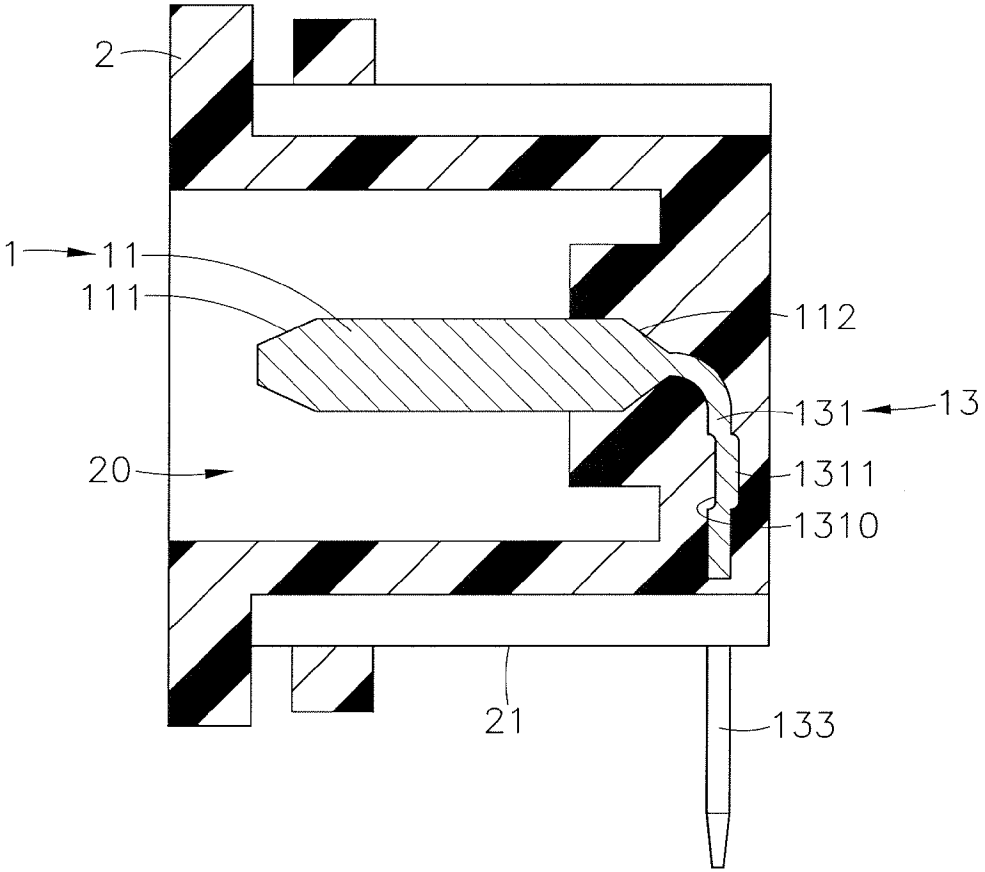
FIG. 3 is a sectional side view of the electric connector of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or " includes any and all combinations of one or more of the associated listed items.

Figure 4:
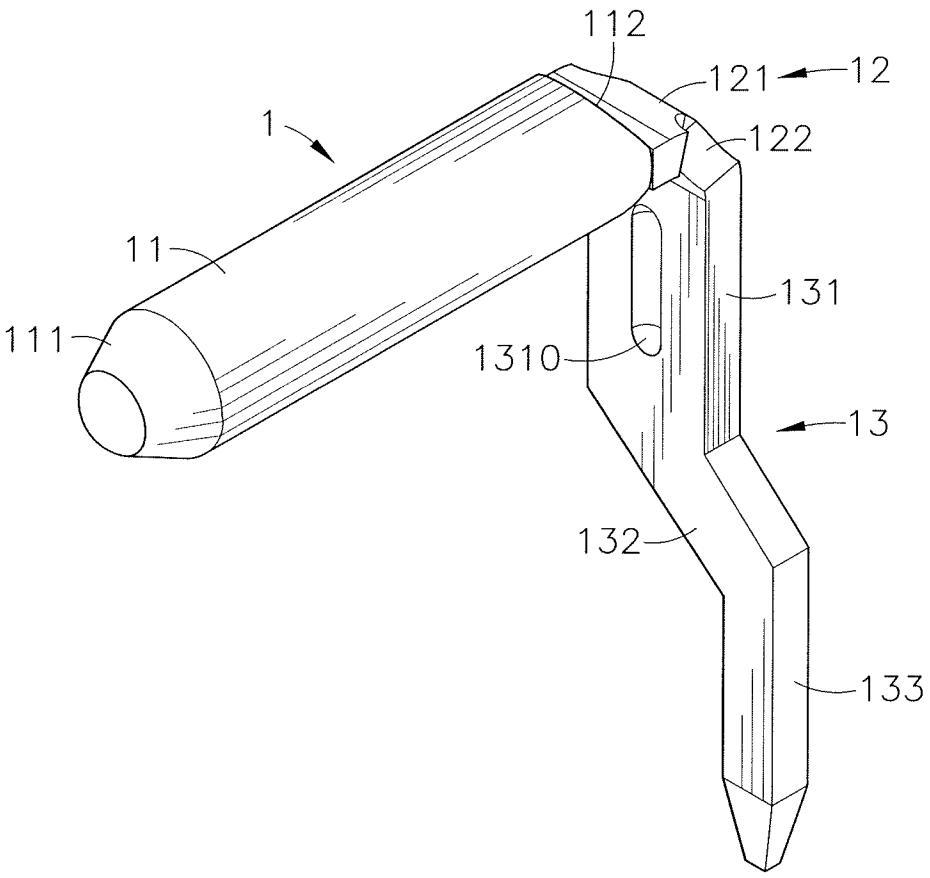
FIG. 4 is an elevational view of a terminal of the present disclosure.
Figure 5:
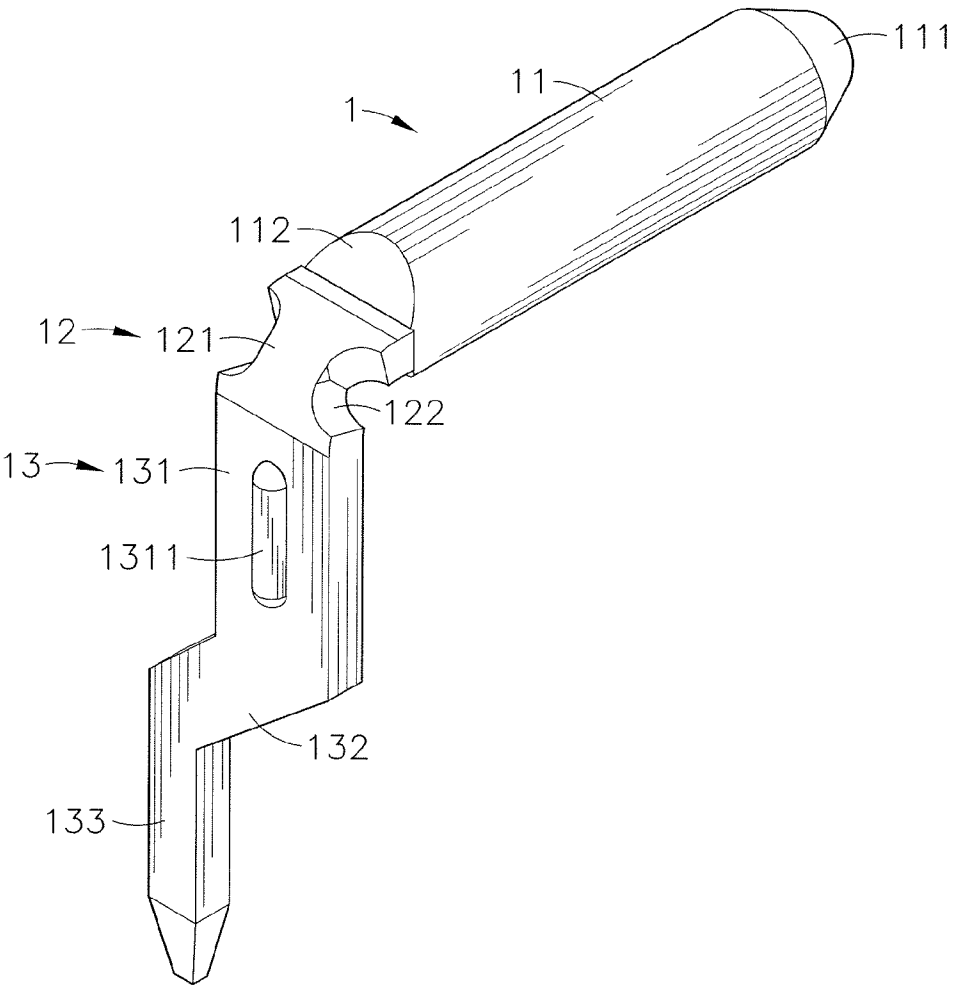
FIG. 5 is an elevational view corresponding to the FIG. 4 while viewed from another angle.
Figure 6:
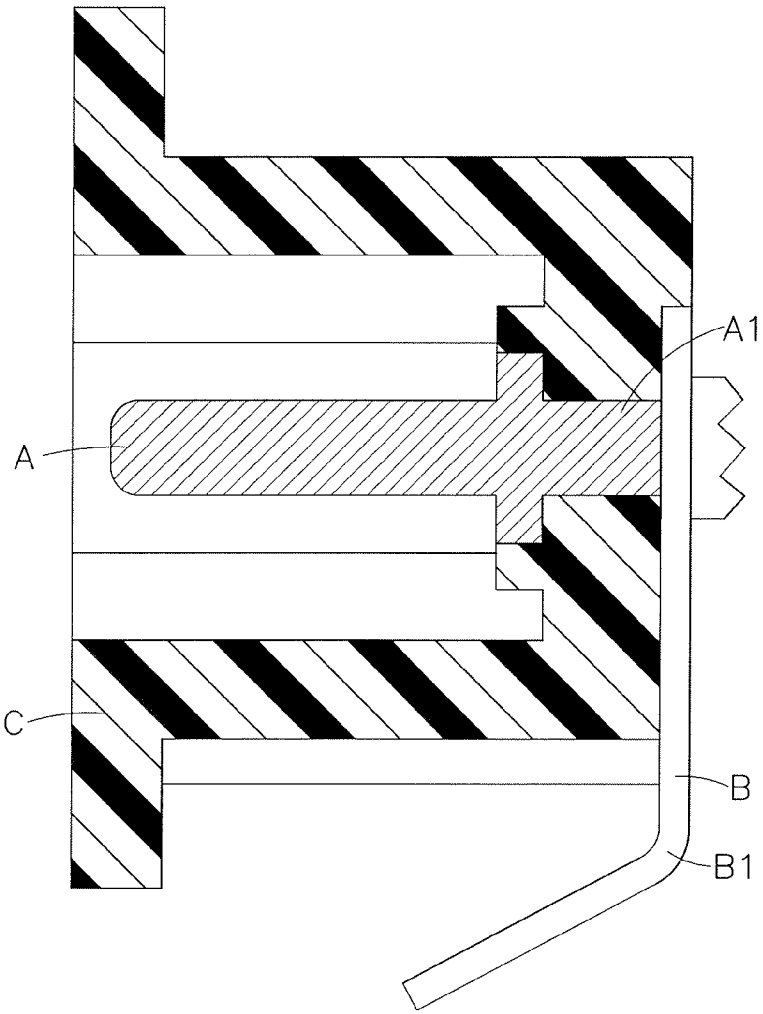
FIG. 6 is a sectional side view of a conventional electric connector.
Figure 7:
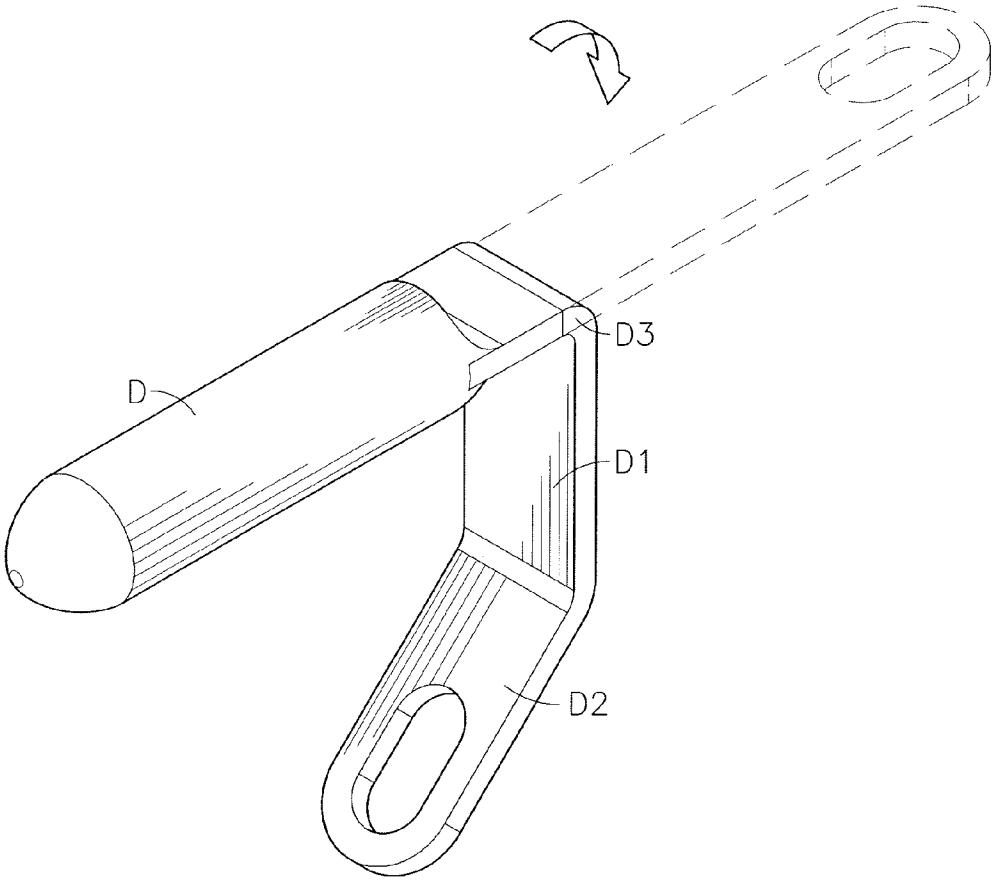
FIG. 7 is an elevational view of a terminal of other conventional electric connector.

Please refer to FIG. 1 through FIG. 5 which respectively show an elevational view, an elevational view corresponding to FIG. 1 while viewed from another angle, a sectional side view, an elevational view of a terminal, and an elevational view corresponding to FIG. 4 while viewed from another angle. As shown in FIGs clearly, the improved structure of an electric connector of the present disclosure includes a plurality of terminals 1 and an insulative base member 2.

The plurality of terminals 1 include butt joint parts 11 of which each defines an oblique cone surface 11 formed at a suspending end thereof and gradually shrunk and inclined outwardly. Each of the butt joint parts 11 has two opposite guiding inclines 112 disposed at other side thereof opposite to the oblique cone surface 111, and the two guiding inclines 112 opposite to the butt joint parts 11 are linked with a joint part 12, and a width of each joint part 12 is equal to a diameter of the butt joint part 11, and each joint part 12 has an arch-shaped necked-down section 121. Each necked-down section 121 has two opposite grooves 122 disposed at central portion thereof, other side of the necked-down section 121 is vertically linked with a positioning section 131 of a soldering part 13, an accommodating groove 1310 is formed at a surface of the positioning section 131 of each soldering part 13 below the butt joint part 11, and a protruding body 1311 is formed at other surface of the positioning section 131 opposite to the accommodating groove 1310. Other end of each positioning section 131 is linked with an extension arm 132 outwardly inclined and gradually shrunk, an insertion section 133 is formed at other end of each extension arm 132, and each soldering part 13 and each butt joint part 11 can be linked at right angle.

The insulative base member 2 is integrally formed to encapsulate the plurality of terminals 1 by an insert molding process, and the insulative base member 2 defines a rectangular docking chamber 20 therein and the butt joint parts 11 of the plurality of terminals 1 can be suspended and extended into the docking chamber 20. A positioning surface 21 is defined at the external of the insulative base member 2 and perpendicular to the docking chamber 20. The joint parts 12 located at sides of butt joint parts 11 of the plurality of terminals 1, and the positioning sections 131 of the soldering parts 13 are integrally encapsulated inside the insulative base member 2, the extension arms 132 at other sides of the positioning sections 131 of the soldering parts 13 are respectively exposed out of the positioning surface 21 and oppositely extended outwardly, and the insertion sections 133 respectively linked with the extension arms 132 are also exposed out of the positioning surface 21. The extension arms 132 and the insertion sections 133 of the soldering parts 13 of the terminals 1 are separately exposed out of positioning surface 21 in the vertical direction. According to above-mentioned configuration, the electric connector of the present disclosure is constructed of the plurality of terminals 1 and the insulative base member 2.

In the preferred embodiment of the present disclosure, the electric connector includes two terminals 1 and an insulative base member 2 integrally formed at the outside of the two terminals 1. By such configuration, the electric connector can be applied as a type of power connector; however, the present disclosure is not limited thereto, and the amount of the terminals 1 can be adjusted upon actual application. The docking chamber 20 of the insulative base member 2 can be designed as different shape upon actual application, for example, the docking chamber 20 can be in a rectangular, circular or elliptic shape for different type of electric connector for transmitting power, electric signal, and so on.

Furthermore, the plurality of terminals 1 can have bar-shaped butt joint parts 11, and the suspending end of each butt joint part 11 defines the oblique cone surface 111 outwardly and gradually shrunk and inclined, and other side of each butt joint part 11 opposite to each oblique cone surface 111 is linked with the arch-shaped joint part 12 which is in plate shape and linked with outer sides of two guiding inclines 112 of the butt joint part 11, to make a width of the joint part 12 equal to a diameter of the butt joint part 11. The joint part 12 of each terminal 1 includes the arch-shaped necked-down section 121 and two arch-shaped grooves 122 located at two opposite sides of the necked-down section 121. While the joint part 12 is bent, the two opposite grooves 122 can disperse stress to avoid stress concentration, and the possibility that the terminal 1 is broken by stress concentration occurred at the joint part 12 can be reduced. The butt joint part 11 and the soldering part 13 of each terminal 1 can be linked at right angle through the joint part 12. The rectangular accommodating groove 1310 can be formed at the positioning section 131 of the soldering part 13 of each terminal 1 by the punching press process, and the corresponding protruding body 1311 is also formed at other side of each positioning section 131 opposite to the accommodating groove 1310. Therefore, while being encapsulated by the insulative base member 2, the joint parts 12 and the positioning sections 131 of the plurality of terminals 1 can be stably fastened inside the insulative base member 2 by using the grooves 122 of the necked-down sections 121 of the joint parts 12 and the accommodating grooves 1310 and protruding bodies 1311 of the positioning sections 131, to enable the butt joint parts 11 of the plurality of terminals 1 to be stably suspended and extended in the docking chamber 20 and hard to be loosened and shifted, whereby the plurality of terminals 1 can be ensured to have nice electric plugging function for improving effect of stably transmitting power or electric signal, improving the yield rate of the plurality of terminals 1, and also enhancing endurability of the electric connector.

The plurality of terminals 1 are respectively linked with the positioning sections 131 of the soldering parts 13 in a direction vertical to the butt joint part 11, and other side of each positioning section 131 is linked with the extension arm 132 which is outwardly inclined and shrunk, and other side of each extension arm 132 is further linked with the insertion section 133. According to various designs that the extension arm 132 is extended and inclined with various predetermined angle (such as 30 degrees, 45 degrees or 60 degrees) and has various length (such as 1 mm, 1.5 mm, 2 mm or 2.5 mm), a distance that the insertion section 133 is extended out of the butt joint part 11 can be adjusted to expose the insertion sections 133 out of the positioning surface 21 of the insulative base member 2, so as to control the distance between the adjacent insertion sections 133 for matching the insertion holes with different pitches on the predetermined circuit board. The present disclosure can facilitate the insertion sections 133 of the terminals 1 to be correspondingly inserted into the insertion holes of the predetermined circuit board, so that the electric connector can be quickly fastened on the predetermined circuit board.

The above description is a preferred embodiment of the present disclosure, but scope of the present disclosure is not limited thereto. The main improvement in structure of the present disclosure is that a side of the butt joint part 11 of each terminal 1 is linked with the arch-shaped joint part 12, and each joint part 12 defines two opposite grooves 122 disposed at two opposite sides of the necked-down section 121 thereof, each joint part 12 is linked with the soldering part 13 in the vertical direction, the width of the joint part 12 of each terminal 1 is equal to the diameter of the butt joint part 11, and the one-piece insulative base member 2 can be integrally formed at the outside of the terminals 1. The arch-shaped necked-down sections 121 of the joint parts 12 of the plurality of terminals 1 can avoid the stress concentration and not be broken easily, so that the purpose of improving the production yield rate of the terminals 1 can be achieved. The butt joint parts 11 of the plurality of terminals 1 are suspended and extended into the docking chamber 20 of the insulative base member 2, the extension arms 132 and the insertion sections 133 of the soldering parts 13 located at other sides of the plurality of terminals 1 are exposed out of the insulative base member 2, to allow the plurality of terminals 1 to be stably fastened inside the insulative base member 2 and not loosened easily, so that the endurability of the electric connector can be further improved. By such way that the extension arm 132 is outwardly extended and inclined with different angle and length, the bias distance between the insertion section 133 and the terminal 1 can be adjusted to facilitate the insertion sections 133 of the terminals 1 to be inserted into the insertion holes of the predetermined circuit board. It should be noted that various equivalent changes, alternations or modifications based on the claims of present disclosure are all consequently viewed as being embraced by the scope of the present disclosure.

Therefore, the present disclosure is mainly to improve the structure of the electric connector, the side of the butt joint part of each terminal is linked with the joint part, and the arch-shaped joint part defines two opposite grooves located at two opposite sides of the necked-down section thereof, other side of each joint part is linked with the soldering part, and the one-piece insulative base member is integrally formed to encapsulate the plurality of terminals to provide the butt joint parts of the plurality of terminals to be suspended and extended into the docking chamber of the insulative base member. Therefore, the joint parts between the butt joint parts of the plurality of terminals and the soldering parts can avoid stress concentration and not easily be broken, so as to improve the yield rate of the plurality of terminals. Additionally, the width of the joint part of each terminal is equal to the diameter of the butt joint part, and the necked-down section has the grooves, and the soldering part has the opposite accommodating cavity and protruding body located at the positioning section thereof, and while the one-piece insulative base member encapsulates the plurality of terminals, the plurality of terminals, the joint parts and the positioning sections can be stably fastened inside the insulative base member, so the present disclosure has an advantage that the butt joint parts of the plurality of terminals are not easily loosened, the purpose of enhancing the endurability of the electric connector can be achieved, and the electric connector can stably transmit power or electronic signal.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An electric connector, comprising a plurality of terminals and an insulative base member formed at an outside of the plurality of terminals, wherein each of the plurality of terminals has a bar-shaped butt joint part which defines an oblique cone surface formed thereon, another side of said bar-shaped butt joint part opposite to said oblique cone surface is linked with a plate-shaped joint part which is bent to vertically extend, and a width of each plate-shaped joint part is equal to a diameter of said bar-shaped butt joint part, said plate-shaped joint part has a necked-down section defining two opposite grooves formed at a bent location of said plate-shaped joint part, and other side of said plate-shaped joint part opposite to said butt joint part is linked with a soldering part in a vertical direction, and said soldering part is bent and laterally extended, said soldering part has a positioning section extended from said plate-shaped joint part, and said positioning section defines an accommodating cavity recessed at a surface thereof facing said butt joint part and a protruding body formed at other surface thereof opposite to said accommodating cavity, and another side of said positioning section opposite to said plate-shaped joint part is linked with an extension arm outwardly inclined and gradually shrunk, and another side of said extension arm opposite to said positioning section is linked with an insertion section which is vertically extended; and wherein said insulative base member is integrally formed to encapsulate a portion of the plurality of terminals by insert molding process, and said insulative base member defines a docking chamber to provide said butt joint parts of the plurality of terminals an area to suspend and extend therein, and said soldering parts of said plurality of terminals are exposed out of a positioning surface formed at a side of said insulative base member, said extension arms of said soldering parts are inclined and extended out of said insulative base member in different directions respectively, and said insertion sections of soldering parts are extended outside of the insulative base member in a direction vertical to said insulative base member.

2. The electric connector according to claim 1, wherein an end of said butt joint part of each of the plurality of terminals defines said oblique cone surface outwardly and gradually shrunk.

3. The electric connector according to claim 1, wherein the other side of said butt joint part of each of the plurality of terminals opposite to said oblique cone surface defines two opposite guiding inclines which are inclined towards the plate-shaped joint part.

4. The electric connector according to claim 1, wherein a side of said butt joint part of each of the plurality of terminals is linked with said necked-down section, and said necked-down section defines two arch-shaped grooves inwardly recessed at two sides of a central portion thereof.

5. The electric connector according to claim 1, wherein said soldering part of each of the plurality of terminals is linked with said plate-shaped joint part and arranged with said butt joint part by right angle, another side of said positioning section is linked with said extension arm which is outwardly inclined and extended, an outer side of said extension arm is linked with said insertion section, and said insertion section and said positioning section are arranged in parallel and connected by an extension arm.

6. The electric connector according to claim 1, wherein said accommodating cavity is rectangular and formed at said positioning section of said soldering part below said butt joint part of each of the plurality of terminals, and said protruding body is rectangular and formed at other surface of said positioning section opposite to said accommodating cavity.

7. The electric connector according to claim 1, wherein said insulative base member is in a transverse and rectangular shape, said plate-shaped joint parts of said terminals and said positioning sections of said soldering parts are fastened inside said insulative base member, extension arms of said terminals are respectively exposed out of said positioning surface and outwardly extended in different directions respectively, and said insertion sections at other side of said extension arms are respectively extended to two opposite sides of said insulative base member.

* * * * *